US009152100B2

(12) United States Patent
Nakamura et al.

(10) Patent No.: US 9,152,100 B2
(45) Date of Patent: Oct. 6, 2015

(54) IMAGE FORMING APPARATUS HAVING A SHEET GUIDE

(71) Applicant: Sharp Kabushiki Kaisha, Osaka-shi, Osaka (JP)

(72) Inventors: Hirokazu Nakamura, Osaka (JP); Kousuke Namisaki, Osaka (JP); Motoki Ohta, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 14/290,279

(22) Filed: May 29, 2014

(65) Prior Publication Data

US 2014/0356018 A1 Dec. 4, 2014

(30) Foreign Application Priority Data

May 30, 2013 (JP) ..... 2013-113663
Mar. 24, 2014 (JP) ..... 2014-059838

(51) Int. Cl.
*G03G 15/20* (2006.01)

(52) U.S. Cl.
CPC ..... *G03G 15/2025* (2013.01); *G03G 15/2028* (2013.01); *G03G 15/2085* (2013.01)

(58) Field of Classification Search
CPC ..... G03G 15/2025; G03G 15/2028; G03G 15/2085
USPC ..... 399/98, 99, 324, 327
See application file for complete search history.

(56) References Cited

U.S. PATENT DOCUMENTS

| | | | | |
|---|---|---|---|---|
| 2004/0131397 | A1* | 7/2004 | Kikuchi | 399/309 |
| 2008/0124144 | A1* | 5/2008 | Mukai et al. | 399/327 |
| 2011/0064450 | A1* | 3/2011 | Ishii et al. | 399/98 |
| 2012/0087702 | A1* | 4/2012 | McNamee et al. | 399/327 |
| 2012/0269531 | A1* | 10/2012 | Suzuki et al. | 399/67 |
| 2013/0236220 | A1* | 9/2013 | Mito et al. | 399/327 |
| 2013/0287460 | A1* | 10/2013 | Kitagawa | 399/333 |
| 2014/0369724 | A1* | 12/2014 | Nakamura et al. | 399/327 |

FOREIGN PATENT DOCUMENTS

| | | |
|---|---|---|
| JP | 2009-86140 A | 4/2009 |
| JP | 2009-169106 A | 7/2009 |

* cited by examiner

*Primary Examiner* — Rodney Bonnette
(74) *Attorney, Agent, or Firm* — Birch, Stewart, Kolasch & Birch, LLP

(57) ABSTRACT

An image forming apparatus includes a pre-fixing sheet guide and a toner collection device. The pre-fixing sheet guide is to let a sheet conveyed along it, the sheet with a toner image transferred thereon at a transfer portion to an end part of the sheet. The sheet guide has a width shorter than a maximum printable sheet width. The toner collection device includes an adsorption member (pressure roller) that is disposed in the vicinity of the pre-fixing sheet guide and having a surface exhibiting conductivity, and a potential difference formation mechanism (earth mechanism) configured to form a potential difference between the surface of the adsorption member and the toner.

10 Claims, 8 Drawing Sheets

IMAGE FORMING APPARATUS HAVING A SHEET GUIDE

CROSS REFERENCE

This Nonprovisional application claims priority under 35 U.S.C. §119(a) on Patent Application No. 2013-113663 filed in Japan on May 30, 2013, and on Patent Application No. 2014-059838 filed in Japan on Mar. 24, 2014, each of the entire contents of which is hereby incorporated by reference.

BACKGROUND OF THE INVENTION

The present invention relates to image forming apparatuses to fix a toner image that is transferred on a sheet by thermo-compression.

Recently there is a growing demand for margin-less printing to enlarge a printing region to at least one end part of a sheet in the width direction that is orthogonal to the sheet conveyance direction, such as printing to enlarge the printing region fully to the periphery of the sheet. Especially electrophotographic printing is attractive because it enables margin-less printing on a sheet of a large size in comparison with photographic sheets. Such margin-less printing for electrophotographic printing can be implemented in principle by simply making a minor design change to change the writing width of an electrostatic latent image on a photoreceptor drum.

The electrophotographic printing, however, has a concern about the surrounding of the transfer portion getting dirty due to toner sticking out from a sheet or flying off from the end part of a sheet because the toner used as a developer is powder, and so has not used margin-less printing positively. Especially when the sheet guide becomes dirty with toner, the toner will be attached to a sheet passing through the sheet guide during the following usual margin printing, and so the printing quality will be degraded unfortunately.

Then Japanese Unexamined Patent Application Publication No. 2009-86140 proposes a method to transfer a toner image with margin on a sheet of one size larger for fixing, followed by cutting the margin, thus implementing apparent margin-less printing.

Japanese Unexamined Patent Application Publication No. 2009-169106 proposes another method of including sheet rear-face charging means at a sheet guide between transfer means and fixing means so as to cause a sheet rear face on the opposite side of the sheet on which a toner image is transferred to take on an electric charge. For margin-less printing, voltage having the same polarity as the voltage applied to the transfer means is applied to the sheet rear-face charging means, thus fixing a not-fixed toner image to the sheet stably.

The method of Japanese Unexamined Patent Application Publication No. 2009-86140 requires a sheet of one size larger to perform margin-less printing on a sheet of a desired size, thus increasing material cost. There is another problem that margin-less printing cannot be performed practically on a sheet of a maximum printable size.

The method of Japanese Unexamined Patent Application Publication No. 2009-169106 enables margin-less printing on a sheet of a desired size directly. However, a toner image created by margin-less printing will have a size wider than the width of the sheet, and this makes it impossible to avoid toner that is not placed on the sheet from flying off. Since the sheet rear-face charging means is electrically charged to a potential to attract toner easily, there is a possibility that the fly-off toner is attached to the sheet rear-face charging means. Since a sheet is conveyed while coming into contact with the sheet rear-face charging means, such toner attached to the sheet rear-face charging means may make the rear face of the sheet dirty.

In view of these conventional problems, it is an object of the present invention to prevent a sheet guide from getting dirty due to toner flying off from an end part of a sheet during margin-less printing, and to improve the collection efficiency of fly-off toner.

SUMMARY OF THE INVENTION

An image forming apparatus of the present invention includes a sheet guide and a toner collection device. The sheet guide is to let a sheet conveyed along it, the sheet with a toner image transferred thereon to at least one end part of the sheet in a width direction that is orthogonal to a conveyance direction of the sheet. The sheet guide has a width shorter than a maximum printable sheet width. The sheet guide may have such a shorter width partially. The toner collection device is disposed in the vicinity of the sheet guide, and is configured to collect toner flying off from a sheet being conveyed along the sheet guide.

This configuration prevents fly-off toner from adhering to an end part of the sheet guide that becomes easily dirty, the toner flying off from the sheet due to impacts and vibrations during the conveyance of the sheet along the sheet guide, on which a toner image is transferred to the end part at a transfer portion. This is because the sheet guide has a width shorter than the maximum printable sheet width. Fly-off toner then can be effectively collected by the toner collection device that is disposed in the vicinity of the sheet guide.

Toner transferred to a sheet is electrically charged. Then as an exemplary configuration of the toner collection device, it is easy to configure the toner collection device with an adsorption member to electrostatically adsorb toner flying off from the sheet, the adsorption member having a surface exhibiting conductivity, and a potential difference formation mechanism configured to form a potential difference between the surface of the adsorption member and the toner.

This configuration allows electrostatically adsorption of the fly-off toner at the surface of the adsorption member due to a potential difference formed between the surface of the adsorption member and the toner. This enables effective collection of the fly-off toner.

In the image forming process, the transfer portion is followed by a fixing portion. In this case, the sheet guide may have the simplest configuration that is a pre-fixing sheet guide disposed upstream of the fixing portion.

Various types of the fixing device are available, among which a configuration including a pressure rotation member that comes into contact with a fixing rotation member under pressure that is heated and rotary driven may be used, whereby the fixing rotation member or the pressure rotation member can double as the adsorption member. This can implement a major element of the toner collection device with a fixing device that is essential to the image forming process. As compared with the case of separately providing a toner collection device, this configuration can suppress an increase in device cost and an increase in device size.

When the sheet guide is a pre-fixing sheet guide, such a sheet guide is disposed so that its downstream end overlaps with the pressure rotation member. In this case, the sheet guide may include a protruding piece that protrudes while inclining toward the pressure rotation member at either end of the downstream end part of the sheet guide as the overlapping portion. This protruding piece serves as a physical guide to move the toner adhering to the both end parts of the sheet guide, thus facilitating the adsorption of the toner at the surface of the pressure rotation member doubling as the adsorption member.

The toner collection device may further include a cleaning mechanism configured to clean the surface of the adsorption member, which allows the adsorption member to be renewed and used repeatedly. For instance, when the pressure rotation member doubles as the adsorption member, a web cleaning device to clean the surface of the pressure rotation member, which is originally provided in the fixing device, can be used for this purpose.

The potential difference formation mechanism may be an electrically-charging mechanism or a static elimination mechanism. In the case of a static elimination mechanism, this may be configured with an earth mechanism to bring the surface of the adsorption member to ground potential. Since the earth mechanism does not consume electricity, the potential difference formation mechanism can be configured in an energy-saving manner. When the pressure rotation member doubles as the adsorption member, an earth member such as an antistatic conductive brush to remove electricity from the surface of the pressure rotation member, which is originally provided in the fixing device, can be used for this purpose.

The present invention sets a width of the sheet guide shorter than the maximum printable sheet width, and so even when the downstream end of the sheet guide overlaps with the pressure rotation member as stated above, both end parts of the surface of the pressure rotation member are not covered with the sheet guide but are exposed to the sheet conveyance path.

In the case where the pressure rotation member is provided with a thermistor for temperature detection, if a detection piece of the thermistor is placed at a center part of the pressure rotation member, a defect may occur in an image formed because the detection piece is of a contact detection type and so it scratches the surface of the pressure rotation member at the center part. To place the detection piece at a part that does not affect the image, the detection piece is configured to come into contact with an end part of the pressure rotation member. In this way, this pre-fixing sheet guide has a structure making the detection piece vulnerable to the adhesion of fly-off toner. Additionally since the detection piece is typically made of a metal elastic body having good thermal conductivity and elasticity, toner, which is electrically charged due to static electricity, easily adheres to the detection piece.

When the fly-off toner adheres to the detection piece of the thermistor to pile up a lot, an error detection of temperature may be induced. Then a protective member is preferably provided so as to prevent the adherence of toner to the detection piece. The protective member preferably is a resin cover or a resin sheet.

The sheet guide may have a width equal to the maximum printable sheet width or the maximum printable sheet width or more. This configuration also enables a certain amount of fly-off toner to be adsorbed at the end part of the surface of the pressure rotation member.

When there is a potential difference between the surface of the pressure rotation member and toner, a first cleaning mechanism is preferably provided to clean the surface of the pressure rotation member. Instead of the first cleaning mechanism, a second cleaning mechanism may be provided so as to clean the surface of the fixing rotation member. Both of the first cleaning mechanism to clean the surface of the pressure rotation member and the second cleaning mechanism to clean the surface of the fixing rotation member may be provided. This allows toner that is not collected by one of the cleaning mechanisms to be collected by the other cleaning mechanism, and so the collection efficiency of the toner can be further improved.

The present invention can prevent the sheet guide from getting dirty due to fly-off toner from the end part of a sheet during margin-less printing and can improve the collection efficiency of fly-off toner, and so can prevent toner from flying off to a wide range and can prevent a sheet being conveyed along the sheet guide from getting dirty on the rear face.

DETAILED DESCRIPTION OF THE INVENTION

Figure 1:
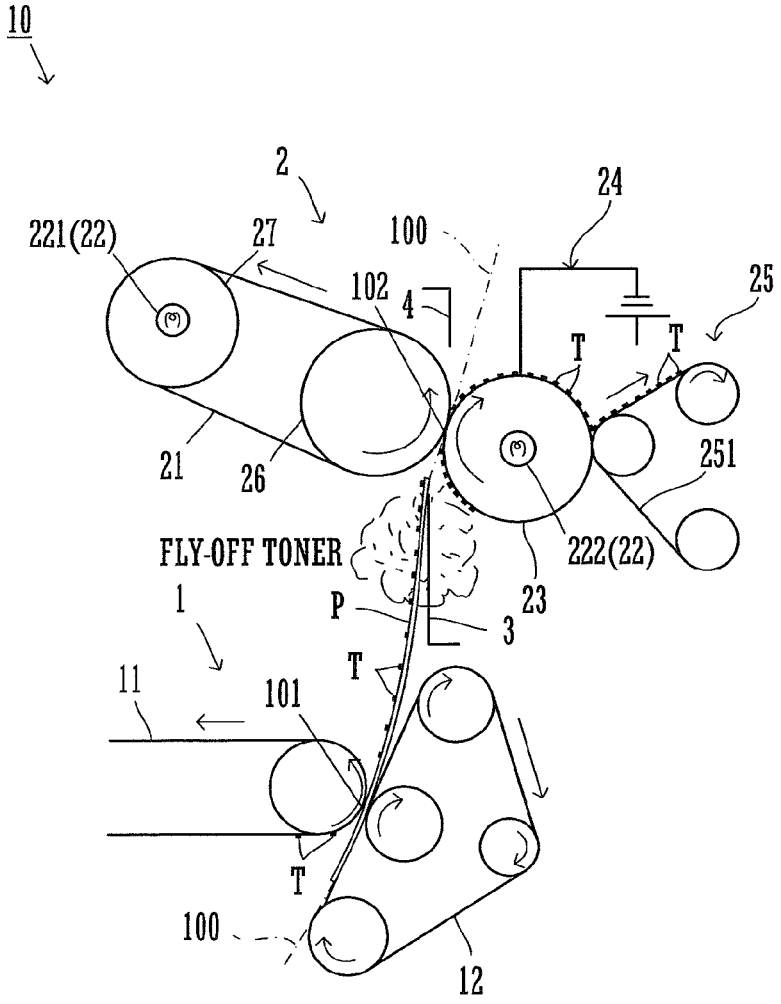
FIG. 1 schematically illustrates the configuration of major parts of an image forming apparatus according to Embodiment 1 of the present invention.

The following describes embodiments of the present invention, with reference to the drawings. FIG. 1 illustrates major parts of an image forming apparatus 10 according to Embodiment 1 of the present invention. Since other configuration making up the image forming apparatus 10, which is not illustrated in the drawing, is known, illustration and descriptions thereof are omitted. The image forming apparatus 10 of the present invention supports margin-less printing to enlarge a printing region to at least one end part of a sheet in the width direction that is orthogonal to the sheet conveyance direction.

As illustrated in FIG. 1, the image forming apparatus 10 includes a transfer portion 101 and a fixing portion 102 that are disposed along a sheet conveyance path 100 to convey a sheet P.

At the transfer portion 101, a transfer device 1 transfers a toner image on a sheet P. In this drawing, letter T indicates toner (powder) to make up a toner image.

The transfer device may be any type. In the present embodiment, a toner image, which is primary-transferred to an intermediate transfer belt 11 that is revolution-driven, is transferred to a one-side face of the sheet P by a secondary transfer belt 12 that is revolution-driven. Such configuration and operation of the transfer device 1 is known, and so their detailed descriptions are omitted.

At the transfer portion 101, the transfer device 1 includes the two belts 11 and 12 that are brought into contact with each other under pressure (nipping) via two opposed rollers, and so a sheet P passing through the transfer portion 101 is conveyed along the sheet conveyance path 100 as these belts 11 and 12 revolve to reach the fixing portion 102.

At the fixing portion 102, a fixing device 2 fixes a not-fixed toner image on the sheet P. The sheet conveyance path 100 is provided with a pre-fixing sheet guide 3 at a part between the transfer portion 101 and the fixing portion 102. The sheet conveyance path 100 is provided with a post-fixing sheet guide 4 at a part downstream of the fixing portion 102. The pre-fixing sheet guide 3 is one example of a sheet guide of the present invention.

The fixing device 2 of the present embodiment includes an endless belt 21, a heat source 22, a pressure roller 23, an earth mechanism 24, and a cleaning mechanism 25.

The endless belt 21 is hung between a driving roller 26 and an idle roller 27. The driving roller 26 is rotary-driven by a not-illustrated driving source, and revolution- (rotary-) drives the endless belt 21. The endless belt 21 is one example of a fixing rotation member of the present invention. The fixing rotation member may be a roller, for example.

The pressure roller 23 comes into contact with the endless belt 21 under pressure at the fixing portion 102. The pressure roller 23 is rotatably supported while being biased to the vector direction from the rotary center toward the fixing portion 102 by a not-illustrated pressure-contact device. Although the pressure-contact device itself does not have a driving source, the pressure roller 23 rotates while being driven with the revolution of the endless belt 21 due to a nip force to come into contact with the endless belt 21 under pressure. The pressure roller 23 is one example of a pressure rotation member of the present invention. Another exemplary pressure rotation member may be a pressure belt in a configuration where a roller, around which the pressure belt as an endless belt extends, comes into contact with the driving roller 26 while sandwiching the pressure belt and the endless belt 21 therebetween. The pressure rotation member may rotate for driving and the fixing rotation member may rotate while being driven.

After passing through the transfer portion 101, the sheet P is guided by the pre-fixing sheet guide 3 to the fixing portion 102 between the endless belt 21 and the pressure roller 23. The fixing portion 102 corresponds to a fixing nip portion of the present invention.

The pressure roller 23 is one example of an adsorption member of the present invention. The pressure roller 23 has a surface exhibiting conductivity.

The heat source 22 heats the endless belt 21. The heat source 22 of the present embodiment includes a main heater 221 and a sub-heater 222. The main heater 221 is built into the idle roller 27, around which the endless belt 21 is hung, and the sub-heater 222 is built into the pressure roller 23.

The earth mechanism 24 brings the surface of the pressure roller 23 to ground potential. Preferable example of the earth mechanism 24 may be an antistatic conductive brush that rotates while coming into contact with the surface of the pressure roller 23. The earth mechanism 24 is one example of a potential difference formation mechanism of the present invention. The potential difference formation mechanism may be an electrically-charging mechanism to electrically charge the surface of the pressure roller 23 positively.

The cleaning mechanism 25 cleans the surface of the pressure roller 23. The present embodiment illustrates, as one example, a web cleaning device that is configured to revolution-drive a web 251 that comes into contact with the surface of the pressure roller 23. The cleaning mechanism 25 is not limited to such a web cleaning device. For instance, this may be a simple cleaning mechanism that is of a type of pressing a peeling claw against the pressure roller 23 for scraping-off.

The web 251 may be strip-shaped non-woven cloth, for example. The web 251 preferably has a dimension in the width direction that is more than the maximum printable sheet width. In one example, the web 251 has a dimension in the width direction that is longer than the maximum printable sheet width by 30 mm on each side. Such a configuration allows the web 251 to wipe off the dirt on the surface of the pressure roller 23 even when fly-off toner T is attached to the surface of the pressure roller 23 on the outside of the maximum printable sheet width.

The present embodiment is configured so that the pressure roller 23, the earth mechanism 24 and the cleaning mechanism 25 make up a toner collection device of the present invention. The toner collection device is provided in the vicinity of the pre-fixing sheet guide 3 that is a sheet guide of the present invention.

Figure 2:
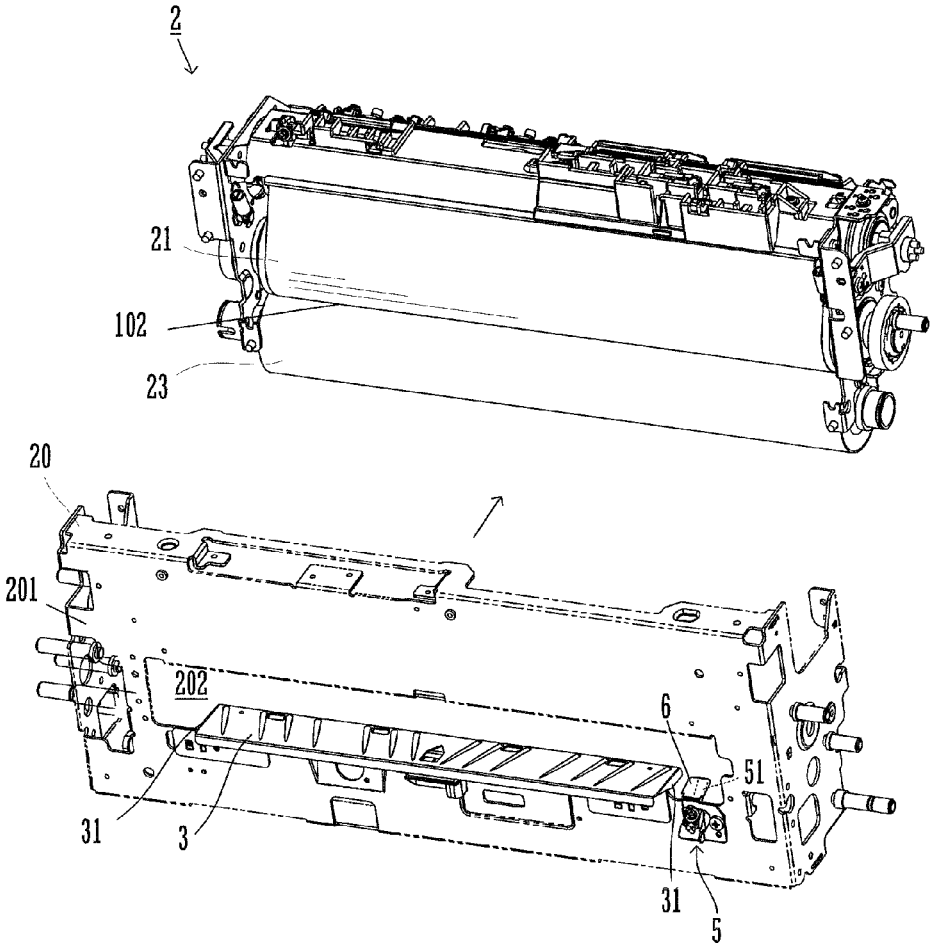
FIG. 2 is a perspective view of a fixing device, showing a housing, a pre-fixing sheet guide and a thermistor separately.

As shown in FIG. 2, the elements of the fixing device 2 as described above are disposed inside of a robust frame 20 as a supporting member. The frame 20 doubles as a pre-fixing cover of the fixing device 2. The frame 20 has a pre-fixing cover portion 201 including an opening 202 facing the fixing portion 102.

Figure 3:
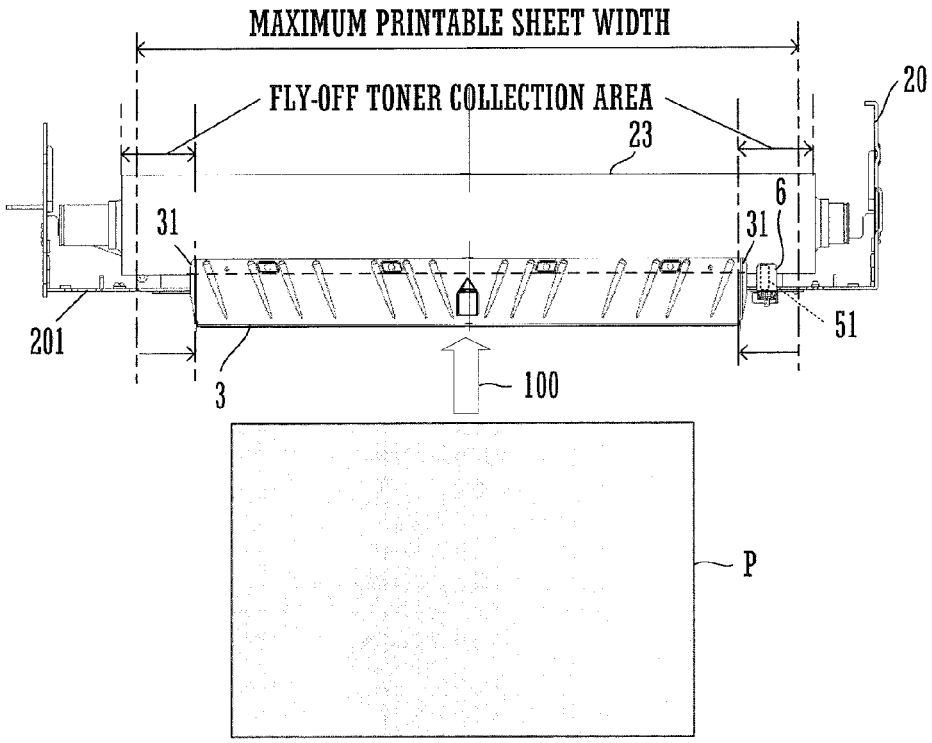
FIG. 3 is a plan view of a pressure roller, a pre-fixing sheet guide and a protective member of a thermistor detection piece in a plane in parallel with the conveyance direction.

The pre-fixing sheet guide 3 is prepared by processing a metal material such as stainless-steel (SUS). The pre-fixing sheet guide 3 is disposed from the outside to the inside of the pre-fixing cover portion 201 via the opening 202 of the pre-fixing cover portion 201. Herein, as shown in FIG. 3, the downstream end of the pre-fixing sheet guide 3 overlaps with the pressure roller 23. The pre-fixing sheet guide 3 has a protruding piece 31 that protrudes while inclining downward toward the pressure roller 23 at either end thereof in the width direction that is orthogonal to the sheet conveyance direction of the downstream end part as the overlapping portion.

As shown in FIG. 3, the pre-fixing sheet guide 3 has a width shorter than the maximum pintable sheet width. This means that, even when the downstream end of the pre-fixing sheet guide 3 overlaps with the pressure roller 23 as stated above, both end parts of the surface of the pressure roller 23 are not covered with the pre-fixing sheet guide 3 but are exposed to the space in the sheet conveyance path 100.

In the case where the pressure roller 23 is provided with a thermistor 5 for temperature detection, if a detection piece 51 of the thermistor 5 is placed at a center part of the pressure roller 23, a defect may occur in an image formed because the detection piece 51 is of a contact detection type and so it scratches the surface of the pressure roller 23 at the center part. Then, as illustrated in the drawing, the thermistor 5 is placed at an end part of the pressure roller 23. In this way, the pre-fixing sheet guide 3 of the present invention has a structure making the detection piece 51 vulnerable to the adhesion of fly-off toner. Additionally since the detection piece 51 is typically made of a metal elastic body having good thermal conductivity and elasticity, toner, which is electrically charged due to static electricity, easily adheres to the detection piece.

When the fly-off toner adheres to the detection piece 51 of the thermistor 5 to pile up a lot, an error detection of temperature may be induced. Then a protective member 6 is preferably provided so as to prevent the adherence of toner to the detection piece 51. The protective member 6 of the present embodiment may be a resin cover that can be detachably attached to the thermistor 5 using a screw. For instance, a resin sheet or the like may be used as the protective member 6, which is directly attachable to a non-detection side face of the detection piece 51.

Figure 4:
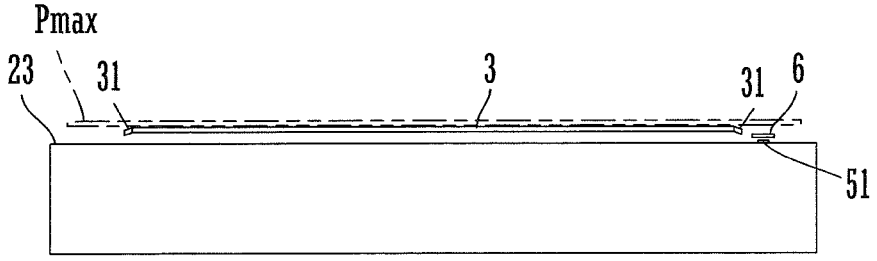
FIG. 4 is a view of a pressure roller, a pre-fixing sheet guide and a protective member of a thermistor detection piece that are projected on a plane orthogonal to the conveyance direction.

As shown in FIG. 4 with a phantom line, the protective member 6 is desirably disposed having a positional relationship closer to the pressure roller 23 than the pre-fixing sheet guide 3 so as not to come into contact with a sheet Pmax having the maximum width that is conveyed along the sheet conveyance path 100.

Referring to FIGS. 1 and 3, the following describes the operation of the thus configured image forming apparatus 10 according to the present embodiment to collect fly-off toner during margin-less printing.

Firstly, at the transfer portion 101, the transfer device 1 transfers a toner image on a sheet P to at least one end part of the sheet P in the width direction (margin-less printing). Receiving the conveyance force from the transfer device 1, this sheet P is conveyed on the sheet conveyance path 100 along the pre-fixing sheet guide 3 to reach the fixing portion 102.

Toner T easily flies off from the sheet P on which a toner image is transferred to at least one end part of the sheet P in the width direction due to vibrations and impacts when the sheet is conveyed along the pre-fixing sheet guide 3. Since the pre-fixing sheet guide 3 has a width shorter than the maximum printable sheet width, less toner T flying off from the sheet P adheres to the end part of the pre-fixing sheet guide 3 in the width direction.

Toner T flying off, which is electrically charged, is electrostatically adsorbed to the surface of the pressure roller 23 due to a potential difference from the surface of the pressure roller 23 that is kept at the earth ground by the earth mechanism 24. At this time, such flying-off toner T is positively guided to an end part of the pressure roller 23 by the protruding piece 31 at the downstream end part of the pre-fixing sheet guide 3 that is inclined toward the pressure roller 23. In this way, flying-off toner T is collected at the end part of the surface of the pressure roller 23. This can improve the collection efficiency of the flying-off toner T. This also can prevent the toner T from flying off to a wide range. This further can prevent the rear face of the sheet P being conveyed along the pre-fixing sheet guide 3 from getting dirty.

The surface of the pressure roller 23, to which toner T may adhere, is cleaned by the cleaning mechanism 25 every revolution of the pressure roller. This allows the pressure roller 23, which doubles as an adsorption member of fly-off toner T, to be renewed and used repeatedly.

Figure 5:
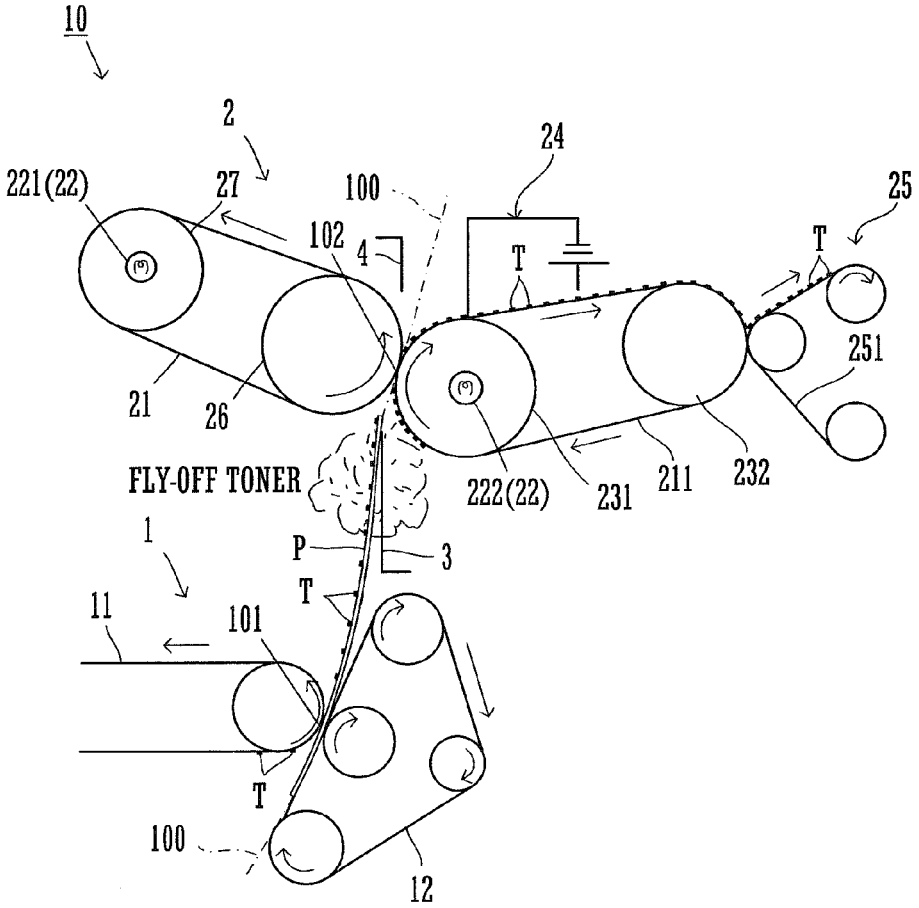
FIG. 5 schematically illustrates the configuration of major parts of an image forming apparatus according to Embodiment 2 of the present invention.

Referring to FIG. 5, the following describes Embodiment 2. The present embodiment includes an endless belt 211 instead of the pressure roller 23 of the fixing device 2 of Embodiment 1 to implement a pressurization method. The endless belt 211 is hung between a first roller 231 and a second roller 232. The first roller 231 is rotatably supported while being biased to the vector direction from the rotary center toward a fixing portion 102 by a not-illustrated pressure-contact device. Although the pressure-contact device itself does not have a driving source, the endless belt 211 rotates while being driven with the revolution of the endlessbelt211 due to a nip force to come into contact with the endlessbelt211 under pressure via the first roller 231. The endless belt 211 of the present embodiment functions as an adsorption member of the present invention.

Figure 6:
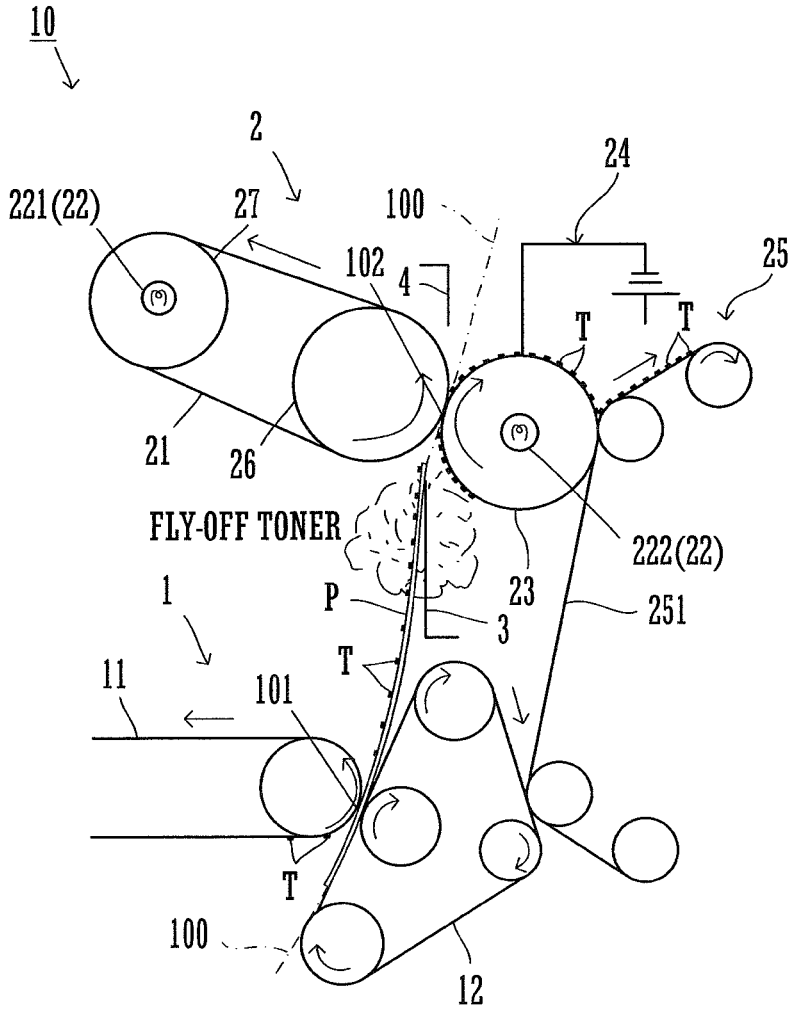
FIG. 6 schematically illustrates the configuration of major parts of an image forming apparatus according to Embodiment 3 of the present invention.

Referring to FIG. 6, the following describes Embodiment 3. The present embodiment is configured so that a web 251 of a cleaning mechanism 25 comes into contact with a secondary transfer belt 12 as well, whereby a pressure roller 23 and the secondary transfer belt 12 can be cleaned by a common cleaning mechanism 25.

Figure 7:
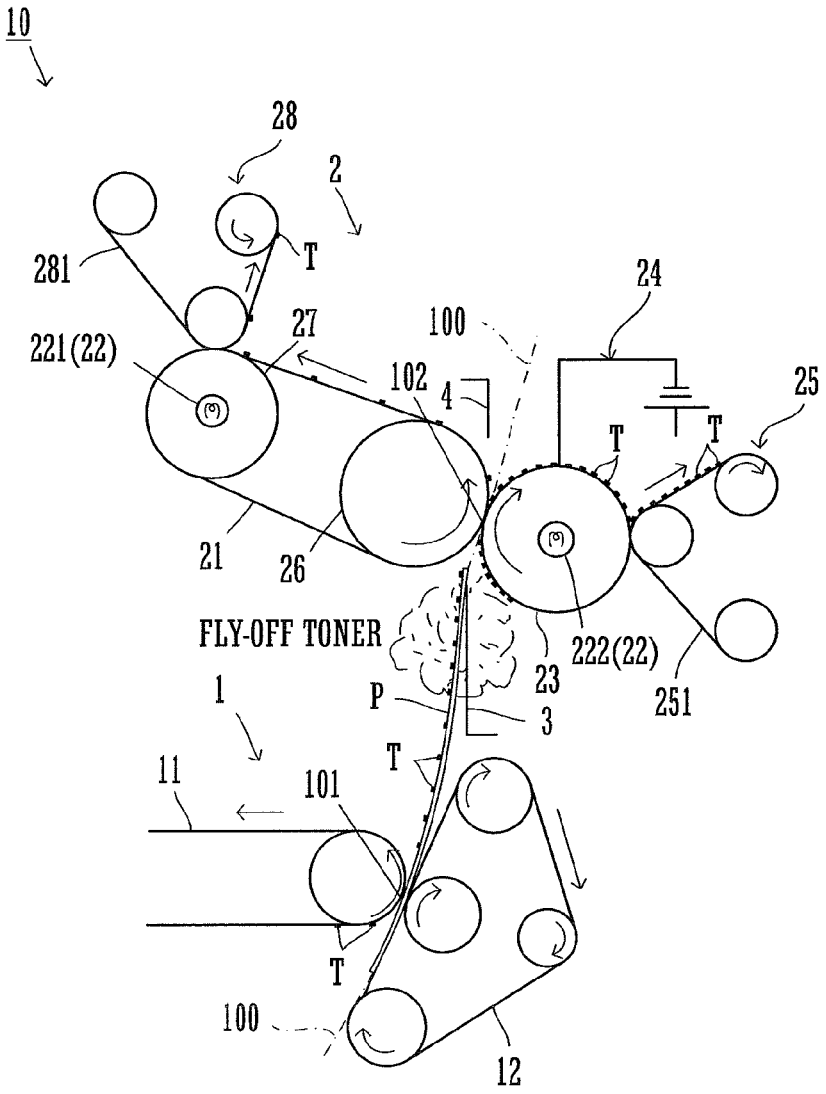
FIG. 7 schematically illustrates the configuration of major parts of an image forming apparatus according to Embodiment 4 of the present invention.

Referring to FIG. 7, the following describes Embodiment 4. An image forming apparatus 10 according to the present embodiment has a configuration similar to the image forming apparatus 10 according to Embodiment 1 except that a cleaning mechanism 28 is further provided to clean the surface of an endless belt 21 in addition to a cleaning mechanism 25 to clean the surface of a pressure roller 23.

Most of the flying-off toner T is adsorbed at the pressure roller 23, and if the pressure roller 23 fails to collect a part of the toner, and such toner T may adhere to the endless belt 21. In that case, this configuration enables cleaning of the surface of the endless belt 21 by the cleaning mechanism 28. This further can prevent a sheet P from getting dirty.

Figure 8:
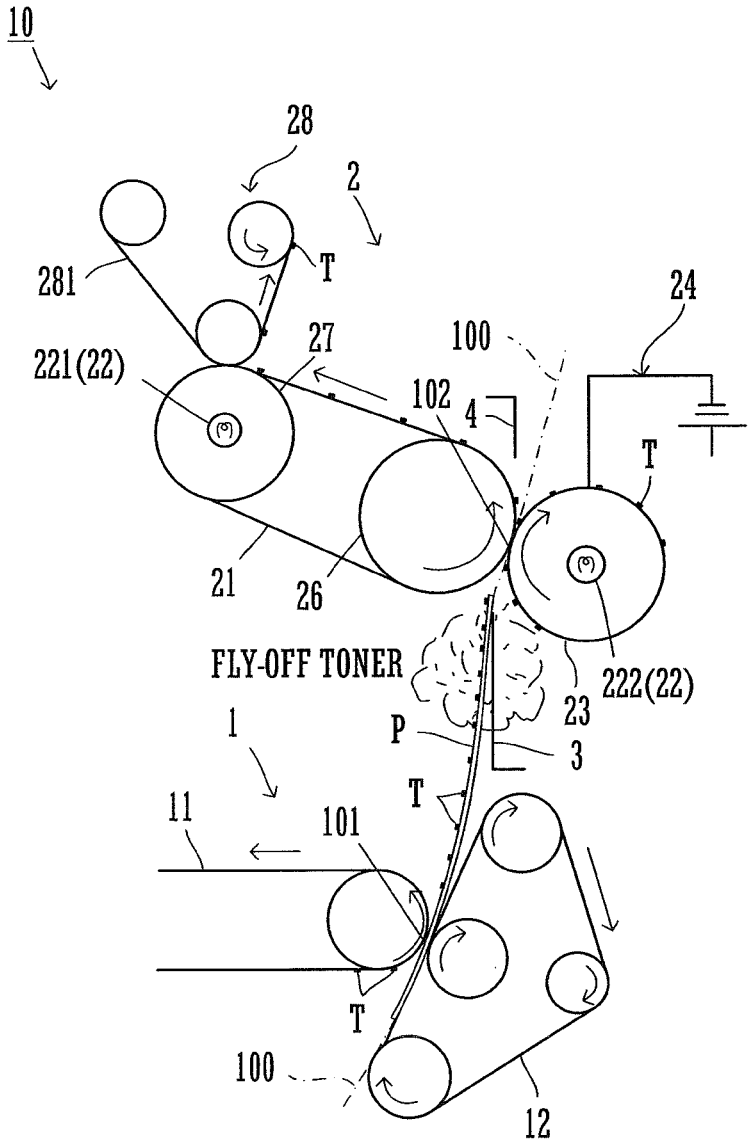
FIG. 8 schematically illustrates the configuration of major parts of an image forming apparatus according to Embodiment 5 of the present invention.

Referring to FIG. 8, the following describes Embodiment 5. An image forming apparatus 10 according to the present embodiment has a configuration similar to the image forming apparatus 10 according to Embodiment 4 except that the cleaning mechanism 25 to clean the surface of the pressure roller 23 is not provided.

In this way, the cleaning mechanism 25 to clean the surface of the pressure roller 23 is not essential to the configuration. Fly-off toner T can be adsorbed at the surface of the pressure roller 23 without the cleaning mechanism 25. When the amount of fly-off toner T is small, a certain pieces of sheets can be dealt with without the cleaning mechanism 25 while controlling the dirt of the sheets within an allowable range.

Although the pre-fixing sheet guide 3 preferably has a width shorter than the maximum printable sheet width as stated above, it may have a width that is set larger than the maximum printable sheet width. In this configuration as well, a certain amount of the fly-off toner T can be adsorbed at the end part of the surface of the pressure roller 23. In this way, the configuration can prevent the pre-fixing sheet guide 3 from getting dirty due to fly-off toner T from the end part of a sheet during margin-less printing, can prevent toner from flying off to a wide range, and can prevent a sheet P being conveyed along the pre-fixing sheet guide 3 from getting dirty on the rear face.

Technical features of the aforementioned embodiments may be combined with each other, whereby a new embodiment can be configured.

The foregoing embodiments are illustrative in all points and should not be construed to limit the present invention. The scope of the present invention is defined not by the foregoing embodiments but by the following claims. Further, the scope of the present invention is intended to include all modifications within the meanings and scopes of claims and equivalents.

What is claimed is:

1. An image forming apparatus comprising:

a sheet guide along which a sheet is conveyed, the sheet with a toner image transferred thereon to at least one end part of the sheet in a width direction that is orthogonal to a conveyance direction of the sheet, the sheet guide having a width shorter than a maximum printable sheet width; and a toner collection device disposed in a vicinity of the sheet guide, the toner collection device being configured to collect toner flying off from the sheet being conveyed along the sheet guide.

2. The image forming apparatus according to claim 1, wherein the toner collection device includes: an adsorption member having a surface exhibiting conductivity; and a potential difference formation mechanism configured to form a potential difference between the surface of the adsorption member and the toner.

3. The image forming apparatus according to claim 2, further comprising a fixing device disposed downstream of the sheet guide, the fixing device being configured to fix the toner image to the sheet, wherein the fixing device includes: a fixing rotation member; a heat source to heat the fixing rotation member; and a pressure rotation member being configured to come into contact with the fixing rotation member under pressure, and the fixing rotation member or the pressure rotation member doubles as the adsorption member.

4. The image forming apparatus according to claim 3, wherein the sheet guide has a downstream end so as to overlap with the pressure rotation member, and includes a protruding piece that protrudes while inclining toward the pressure rotation member at either end of a part of the downstream end of the sheet guide.

5. The image forming apparatus according to claim 3, further comprising: a detection piece that comes into contact with an end part of the pressure rotation member and a thermistor to detect a temperature of the pressure rotation member, wherein the thermistor further includes a protective member to prevent toner from adhering to the detection piece.

6. The image forming apparatus according to claim 2, wherein the toner collection device further includes a cleaning mechanism configured to clean the surface of the adsorption member.

7. The image forming apparatus according to claim 2, wherein the potential difference formation mechanism includes an earth mechanism to remove electricity from the surface of the adsorption member.

8. An image forming apparatus comprising:

a sheet guide along which a sheet is conveyed, the sheet with a toner image transferred thereon to at least one end part of the sheet in a width direction that is orthogonal to a conveyance direction of the sheet;

a fixing device including a fixing rotation member; a heat source to heat the fixing rotation member; and a pressure rotation member being configured to come into contact with the fixing rotation member under pressure and having a surface exhibiting conductivity, the fixing device being configured to fix the toner image to the sheet that is guided by the sheet guide to a fixing nip portion located between the fixing rotation member and the pressure rotation member;

a potential difference formation mechanism configured to form a potential difference between the surface of the pressure rotation member and the toner; and a detection piece that comes into contact with an end part of the pressure rotation member and a thermistor to detect a temperature of the pressure rotation member, wherein the thermistor further includes a protective member to prevent toner from adhering to the detection piece.

9. The image forming apparatus according to claim 8, further comprising a first cleaning mechanism to clean the surface of the pressure rotation member.

10. The image forming apparatus according to claim 8, further comprising a second cleaning mechanism to clean a surface of the fixing rotation member.

* * * * *